US010031463B2

(12) United States Patent
Hozumi et al.

(10) Patent No.: US 10,031,463 B2
(45) Date of Patent: Jul. 24, 2018

(54) BELT DEVICE, BELT CONTROL DEVICE, AND IMAGE FORMING APPARATUS INCLUDING SAME

(71) Applicants: Yoshiki Hozumi, Kanagawa (JP); Naomi Sugimoto, Kanagawa (JP); Hisashi Kikuchi, Kanagawa (JP)

(72) Inventors: Yoshiki Hozumi, Kanagawa (JP); Naomi Sugimoto, Kanagawa (JP); Hisashi Kikuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 12 days.

(21) Appl. No.: 15/421,741

(22) Filed: Feb. 1, 2017

(65) Prior Publication Data

US 2017/0242387 A1 Aug. 24, 2017

(30) Foreign Application Priority Data

Feb. 23, 2016 (JP) ..... 2016-032084

(51) Int. Cl.
*B65H 5/22* (2006.01)
*G03G 15/00* (2006.01)
(Continued)

(52) U.S. Cl.
CPC ..... *G03G 15/6529* (2013.01); *B65H 5/021* (2013.01); *B65H 9/002* (2013.01); *B65H 2301/331* (2013.01); *B65H 2404/25* (2013.01); *B65H 2801/06* (2013.01); *G03G 2215/00143* (2013.01)

(58) Field of Classification Search
CPC ..... G03G 2215/00151; G03G 2215/00143; B65H 5/021; B65H 2404/211; B65H 2404/25
See application file for complete search history.

(56) References Cited

U.S. PATENT DOCUMENTS 5,365,321 A * 11/1994 Koshimizu ..... G03G 15/2064 198/806
2006/0119029 A1* 6/2006 Kitamura ..... B41J 11/007 271/275
(Continued)

FOREIGN PATENT DOCUMENTS

JP 2006-267243 10/2006
JP 2009-186910 8/2009
(Continued)

*Primary Examiner* — Howard J Sanders
(74) *Attorney, Agent, or Firm* — Oblon, McClelland, Maier & Neustadt, L.L.P.

(57) ABSTRACT

A belt control device includes a holder to movably support a rotation shaft of at least one of the plurality of rotators around which a belt is looped, a contact part to contact an end of the belt as the belt moves in a belt width direction, a stationary frame part disposed facing the holder, a shaft moving device to move the rotation shaft as the belt moves, and at least one projection disposed on one of the stationary frame part and the holder. The projection is to contact the other of the stationary frame part and the holder. The projection includes a long projection having a contact portion extending in a shaft moving direction in which the rotation shaft moves, and the contact portion is contactable with the other of the stationary frame part and the holder.

9 Claims, 5 Drawing Sheets

(51) Int. Cl.
*B65H 5/02* (2006.01)
*B65H 9/00* (2006.01)

(56) References Cited

U.S. PATENT DOCUMENTS

| | | | | |
|---|---|---|---|---|
| 2011/0103822 | A1 | 5/2011 | Sugiura et al. | |
| 2013/0192959 | A1* | 8/2013 | Kitamura | B65H 5/021 198/806 |
| 2013/0306440 | A1 | 11/2013 | Asaoka et al. | |
| 2013/0306441 | A1 | 11/2013 | Asaoka et al. | |
| 2014/0008184 | A1 | 1/2014 | Hozumi et al. | |
| 2014/0083821 | A1 | 3/2014 | Hozumi et al. | |
| 2014/0147181 | A1 | 5/2014 | Sugiura et al. | |
| 2014/0183007 | A1 | 7/2014 | Hozumi et al. | |
| 2014/0209437 | A1 | 7/2014 | Hozumi et al. | |
| 2015/0090564 | A1 | 4/2015 | Iwaya et al. | |
| 2015/0117914 | A1 | 4/2015 | Hozumi et al. | |
| 2015/0125189 | A1 | 5/2015 | Hozumi et al. | |
| 2015/0227089 | A1 | 8/2015 | Hozumi et al. | |
| 2015/0301484 | A1 | 10/2015 | Hozumi et al. | |
| 2015/0314976 | A1 | 11/2015 | Hozumi et al. | |
| 2015/0344227 | A1 | 12/2015 | Asaoka et al. | |
| 2016/0062279 | A1 | 3/2016 | Hozumi et al. | |
| 2016/0139553 | A1 | 5/2016 | Hozumi et al. | |
| 2016/0251166 | A1 | 9/2016 | Hozumi et al. | |

FOREIGN PATENT DOCUMENTS

| | | |
|---|---|---|
| JP | 2010-230958 | 10/2010 |
| JP | 2012-103286 | 5/2012 |
| JP | 2014-095737 | 5/2014 |
| JP | 2016-156874 | 9/2016 |

* cited by examiner

BELT DEVICE, BELT CONTROL DEVICE, AND IMAGE FORMING APPARATUS INCLUDING SAME

CROSS-REFERENCE TO RELATED APPLICATIONS

This patent application is based on and claims priority pursuant to 35 U.S.C. § 119(a) to Japanese Patent Application No. 2016-032084, filed on Feb. 23, 2016, in the Japan Patent Office, the entire disclosure of which is hereby incorporated by reference herein.

BACKGROUND

Technical Field

Embodiments of the present invention generally relate to a belt device, a belt control device, and an image forming apparatus, such as a copier, a printer, a facsimile machine, or a multifunction peripheral having at least two of copying, printing, facsimile transmission, plotting, and scanning capabilities.

Description of the Related Art

There are devices that include an endless belt that rotates in a state in which the belt is entrained around a plurality of support rollers. The endless belt can be drawn to one side in the axial direction (i.e., belt width direction) of at least one of support rollers, around which the belt is looped (i.e., belt deviation). Therefore, such devices further include a belt control device that corrects deviation of the belt in the axial direction of the support roller.

SUMMARY

An embodiment of the present invention provides a belt control device. The belt control device to control a belt looped around a plurality of rotators. The belt control device includes a holder to movably support a rotation shaft of at least one of the plurality of rotators around which the belt is looped, a contact part to contact an end of the belt as the belt moves in a belt width direction, a stationary frame part disposed facing the holder, a shaft moving device to move the rotation shaft as the belt moves, and at least one projection disposed on one of the stationary frame part and the holder. The projection is to contact the other of the stationary frame part and the holder. The projection includes a long projection having a contact portion extending in a shaft moving direction in which the rotation shaft moves, and the contact portion is contactable with the other of the stationary frame part and the holder.

In another embodiment, a belt device includes the belt, the rotators, and the belt control device described above.

In yet another embodiment, an image forming apparatus includes an image forming unit to form an image and the belt device described above, to transport one of the image and a recording medium bearing the image.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
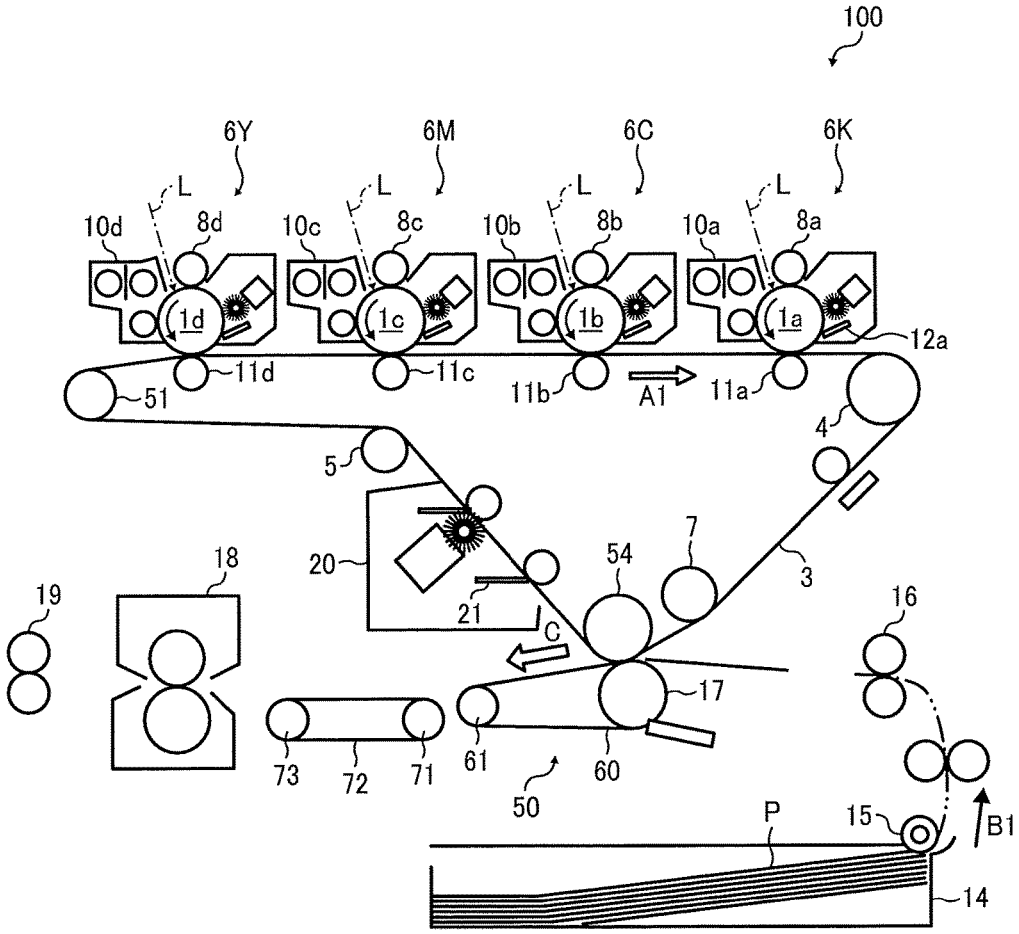
FIG. 1 is a schematic diagram illustrating an image forming apparatus according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For example, to correct the deviation of an endless belt looped around a plurality of support rollers in the axial direction of the support roller, one of the support rollers is inclined relative to the other support rollers to return the belt in the direction opposite to the direction to which the belt has deviated.

For example, a belt contact part is disposed on the rotation shaft of the roller to be inclined (hereinafter "inclining roller"). The belt contact part is to move in the axial direction of the inclining roller and contact an end of the belt. Further, a shaft inclining member to move in the axial direction is disposed on the rotation shaft and closer than the belt contact part to the end of the shaft, toward which the belt contact part moves. The shaft inclining member has an inclined face inclined such that the inclined face approaches the axis of the inclining roller as the position in the axial direction moves to the end side.

The end portion of the rotation shaft of the inclining roller is held by a roller shaft holder such that the rotation shaft can be inclined. The roller shaft holder is rotatable on a support shaft disposed on a stationary frame part (e.g., a device side plate) secured to a device body. The roller shaft holder includes a biasing member such as a spring, an end of which is secured to the stationary frame part. The biasing member constantly biases the inclining roller in the direction from an inclined posture toward an initial posture.

When belt deviation occurs, the end of the belt contacts the belt contact part. With the force of contact, the belt contact part moves to the end side in the axial direction and contacts the shaft inclining member. As the shaft inclining member, contacted by the belt contact part, moves to the end side in the axial direction, the inclined face of the shaft inclining member contacts a shaft guide secured to the device body. As the shaft inclining member being in contact with the shaft guide moves to the end side in the axial direction, the contact position of the shaft guide with the inclined face of the shaft inclining member moves along the inclined face outward in the radial direction. Then, the shaft inclining member pushes the rotation shaft of the inclining roller to the side opposite the side to which the contact position of the shaft guide has moved. Thus, the inclining roller is inclined. With the inclining, the belt drawn to one side of the inclining roller is moved back toward the center side of the inclining roller.

Referring now to the drawings, wherein like reference numerals designate identical or corresponding parts throughout the several views thereof, and particularly to FIG. 1, an image forming apparatus according to an embodiment of the present invention is described. As used herein, the singular forms "a", "an", and "the" are intended to include the plural forms as well, unless the context clearly indicates otherwise.

It is to be noted that reference characters Y, M, C, and K represent yellow, magenta, cyan, and black, respectively. Reference characters a, b, c, and d attached to reference numerals in FIG. 1 indicate only that components indicated thereby are used for forming black, cyan, magenta, and yellow images, respectively, and hereinafter may be omitted when color discrimination is not necessary.

FIG. 1 is a schematic view illustrating an image forming apparatus 100 (e.g., a printer) according to the present embodiment. For example, an example of an image forming apparatus according to an embodiment of the present discloser is an electrophotographic printer.

The image forming apparatus 100 includes four image forming units 6Y, 6M, 6C, and 6K inside a housing of the image forming apparatus 100. The image forming units 6Y, 6M, 6C, and 6K respectively include photoconductors 1*a*, 1*b*, 1*c*, and 1*d*. Toner images of different colors are formed on the photoconductors 1*a*, 1*b*, 1*c*, and 1*d*, respectively. More specifically, black toner images, magenta toner images, cyan toner images, and yellow toner images are formed on the photoconductors 1*a*, 1*b*, 1*c*, and 1*d*, respectively. In the present embodiment, the photoconductors 1*a*, 1*b*, 1*c*, and 1*d* are drum-shaped. Alternatively, the image forming apparatus 100 can employ, as photoconductors, endless belts entrained around a plurality of rollers and driven to rotate.

The image forming apparatus 100 further includes an intermediate transfer belt 3 shaped into a loop, serving as an intermediate transfer member (or an image bearer). The intermediate transfer belt 3 faces the four photoconductors 1*a*, 1*b*, 1*c*, and 1*d*. Another embodiment employs, instead of the intermediate transfer belt 3, a drum-shaped or film-shaped intermediate transfer member. The surface (i.e., an outer face) of each of the photoconductors 1*a*, 1*b*, 1*c*, and 1*d* contacts the outer face of the intermediate transfer belt 3. The intermediate transfer belt 3 is looped taut around a plurality of support rollers (i.e., support rotators) including a driving roller 4, tension rollers 5 and 51, a repulsive roller 54, an entry roller 7, and the like. As a drive source drives the driving roller 4, which is one of the support rollers, the intermediate transfer belt 3 rotates (or endlessly travels) in the direction indicated by arrow A1 in FIG. 1.

The intermediate transfer belt 3 is either a single-layer belt or a multi-layer belt. In the case of a multi-layer belt, it is preferable that a base layer is made of, for example, a relatively inelastic fluorine resin, a polyvinylidene fluoride (PVDF) sheet, or polyimide resin, and a coating layer is made of fluorine resin to make the outer face of the belt smooth. In the case of a single-layer belt, the belt can be made of, selected from, for example, polyvinylidene fluoride (PVDF), polycarbonate (PC), polyimide (PI), or the like.

Regardless of the color of toner, the configuration and operation to form toner images on the photoconductors 1*a*, 1*b*, 1*c*, and 1*d* are similar. Similarly, the configuration and operation to primarily transfer the toner images onto the intermediate transfer belt 3 are similar regardless of the color of toner. Accordingly, a description is given of the configuration and operation to form black toner images on the photoconductor 1*a* and primarily transfer black toner images onto the intermediate transfer belt 3. Descriptions of the configuration and operation of other colors are omitted to avoid redundancy.

The photoconductor 1*a* rotates counterclockwise in FIG. 1. As a static eliminating device irradiates the outer face of the photoconductor 1*a* with light, the surface potential of the photoconductor 1*a* is initialized. A charging device 8*a* uniformly charges the initialized outer face of the photoconductor 1*a* to a predetermined polarity (in the present embodiment, a negative polarity). Subsequently, an exposure device (i.e., a latent image forming device) irradiates the charged outer face of the photoconductor 1*a* with a modulated laser beam L, thereby forming an electrostatic latent image on the surface of the photoconductor 1*a*. According to the present embodiment, the exposure device is a laser writing device that emits the laser beam L. Alternatively, the exposure device can include a light-emitting diode (LED) array and an imaging device. When the electrostatic latent image on the photoconductor 1*a* passes a developing range opposing a developing device 10*a*, the electrostatic latent image is developed with black toner into a visible image.

Primary transfer rollers 11*a*, 11*b*, 11*c*, and 11*d* serving as primary transfer devices are disposed inside the looped intermediate transfer belt 3, facing the photoconductors 1*a*, 1*b*, 1*c*, and 1*d*, respectively. The primary transfer roller 11*a* contacts the inner face of the intermediate transfer belt 3 to form a primary transfer nip between the photoconductor 1*a* and the intermediate transfer belt 3. To the primary transfer roller 11*a*, a primary transfer voltage opposite in polarity to the toner image on the photoconductor 1*a* is applied. In the present embodiment, the primary transfer voltage is in a plus (positive) polarity. Thus, a primary-transfer electrical field is generated between the photoconductor 1*a* and the intermediate transfer belt 3, and the toner image on the photoconductor 1*a* is electrically and primarily transferred onto the intermediate transfer belt 3 that rotates in synchronization with the photoconductor 1*a*. After the toner image is primarily transferred onto the intermediate transfer belt 3, a cleaning device 12*a* removes residual toner remaining on the surface of the photoconductor 1*a*.

In full-color image formation (full-color mode) employing toner of four different colors, similar to the black toner image, a magenta toner image, a cyan toner image, and a yellow toner image are formed on the photoconductors 1*b*, 1*c*, and 1*d*, respectively. The magenta, cyan, and yellow toner images are transferred onto the intermediate transfer belt 3 and superimposed one atop the other on the black toner image on the intermediate transfer belt 3.

By contrast, in single-color or monochrome image formation (single-color mode) employing black toner, the primary transfer rollers 11*b*, 11*c*, and 11*d* other than the primary transfer roller 11*a* for black are moved away from the photoconductors 1*b*, 1*c*, and 1*d* for magenta, cyan, and yellow, thereby disengaging the photoconductors 1*b*, 1*c*, and 1*d* from the intermediate transfer belt 3. In a state in which only the photoconductor 1*a* is in contact with the intermediate transfer belt 3, the black toner image is primarily transferred onto the intermediate transfer belt 3.

As illustrated in FIG. 1, a sheet feeder 14 is disposed in a bottom section of the body of the image forming apparatus 100. The sheet feeder 14 includes a sheet feeding roller 15 to pick up and send a recording medium P (i.e., a recording sheet) in the direction indicated by arrow B1 in FIG. 1. Then, a registration roller pair 16 forwards the recording medium P at a predetermined timing to a secondary transfer nip, at which the intermediate transfer belt 3 looped around the repulsive roller 54 contacts a secondary transfer belt 60 of a secondary transfer device 50. At that time, the repulsive roller 54 is supplied with a predetermined secondary transfer voltage to secondarily transfer the toner image from the intermediate transfer belt 3 onto the recording medium P.

The secondary transfer device 50 further includes a secondary transfer roller 17 and a separation roller 61, around which the secondary transfer belt 60 is looped taut. In the present embodiment, as the secondary transfer roller 17 rotates as a driving roller, the secondary transfer belt 60 rotates in the direction indicated by arrow C in FIG. 1. The recording medium P, onto which the toner image is secondarily transferred, is carried on the outer face of the secondary transfer belt 60 and transported in a state in which the recording medium P is electrostatically attracted to the outer face of the secondary transfer belt 60. Subsequently, the recording medium P leaves the outer face of the secondary transfer belt 60 due to curvature of a portion of the secondary transfer belt 60 winding around the separation roller 61. The recording medium P is further transported in a sheet conveyance direction by a conveyor belt 72 disposed downstream from the secondary transfer belt 60 in the sheet conveyance direction.

The conveyor belt 72 is looped around a driving roller 71 and a driven roller 73. The conveyor belt 72 transports the recording medium P bearing the toner image to a fixing device 18 disposed downstream from the conveyor belt 72 in a state in which the recording medium P is electrostatically attracted onto the conveyor belt 72. When the recording medium P passes therethrough, the fixing device 18 fixes the toner image on the recording medium P with heat and pressure. After the recording medium P passes through the fixing device 18, the recording medium P is discharged outside the apparatus body through an output roller pair 19 of a discharge section. For example, the conveyor belt 72 is made of ethylene-propylene-diene monomer (EPDM) and 1 mm in thickness.

Further, a belt cleaning device 20 removes residual toner on the intermediate transfer belt 3 after the toner image is secondarily transferred therefrom. In the present embodiment, the belt cleaning device 20 includes a cleaning blade 21 made of, for example, urethane. The posture of the cleaning blade 21 abutting against the intermediate transfer belt 3 is counter to the direction of movement of the intermediate transfer belt 3. The belt cleaning device 20 is not limited to the structure described above but can be selected from various cleaning types. For example, a cleaning device employing capacitance can be used.

Next, a description is provided of a shaft inclining device 70 of the secondary transfer device 50, which includes the secondary transfer belt 60. The shaft inclining device 70 serves as a belt control device to correct or adjust belt deviation.

Figure 2A:
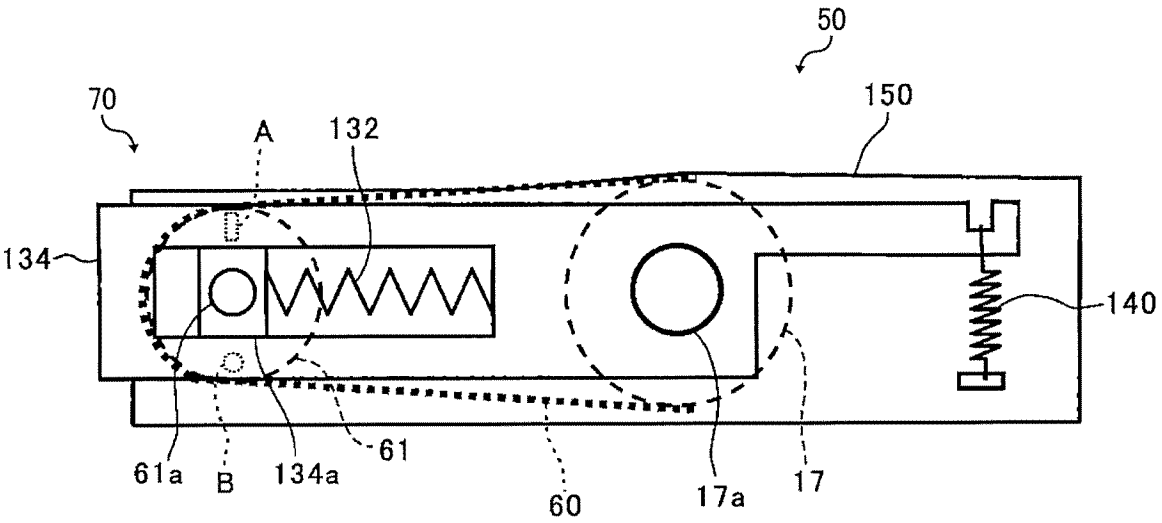
FIGS. 2A and 2B are schematic views of a shaft inclining device of a secondary transfer device employed in the image forming apparatus of FIG. 1, as viewed in the axial direction of a separation roller.
Figure 2B:
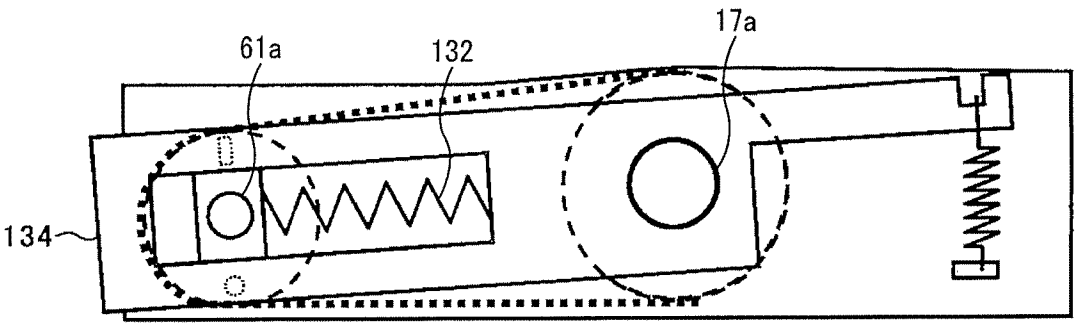
Figure 3:
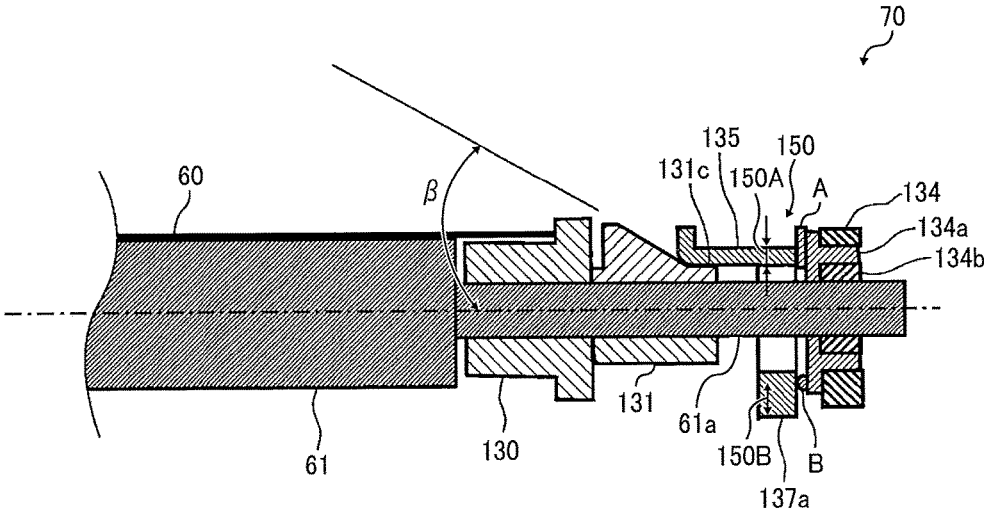
FIG. 3 is a cross-sectional view cut along a rotation shaft of the separation roller and schematically illustrates the shaft inclining device immediately after being assembled.
Figure 4:
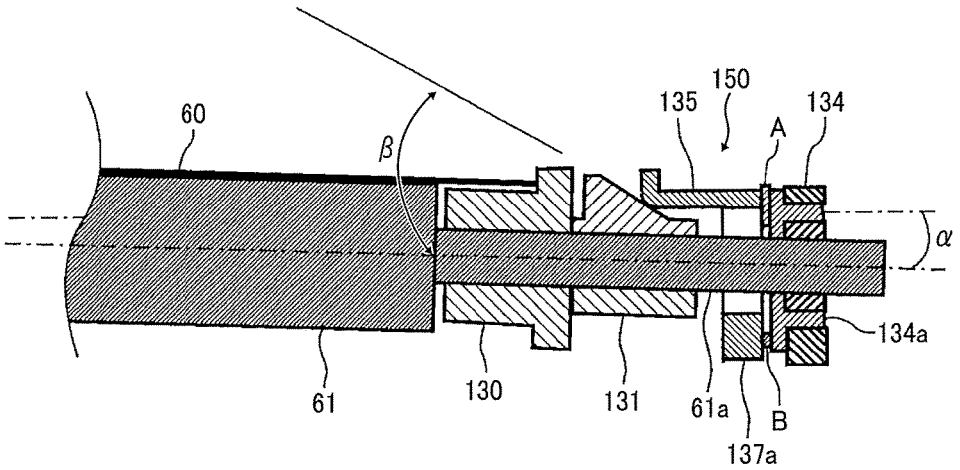
FIG. 4 is a cross-sectional view cut along the rotation shaft of the separation roller and schematically illustrates the shaft inclining device after belt deviation adjustment.

FIGS. 2A and 2B are schematic views of the shaft inclining device 70 as viewed in the axial direction of the separation roller 61. FIG. 2A illustrates a state immediately after assembling, and FIG. 2B illustrates a state after adjustment of belt deviation (or skew correction). FIG. 3 is a cross-sectional view cut along a rotation shaft (hereinafter "separation roller shaft 61*a*") of the separation roller 61 and schematically illustrates the shaft inclining device 70 immediately after being assembled. FIG. 4 is a cross-sectional view cut along the separation roller shaft 61*a* and schematically illustrates the shaft inclining device 70 after belt deviation adjustment.

As illustrated in FIGS. 2A and 2B, the shaft inclining device 70 of the secondary transfer device 50 tilts the shaft. The shaft inclining device 70 serves as the belt control device to adjust belt deviation. The shaft inclining device 70 tilts the separation roller shaft 61*a* of the separation roller 61, which is one of the support rollers supporting the secondary transfer belt 60, thereby restricting the amount of deviation of the secondary transfer belt 60 within a predetermined permissible range.

In the secondary transfer device 50 according to the present embodiment, the shaft inclining device 70 is disposed at each of a first end and a second end of the separation roller 61, and the structure and operation of the shaft inclining devices 70 are similar. Accordingly, the description is given of the shaft inclining device 70 at the first end of the separation roller 61 of the shaft inclining device 70.

As illustrated in FIG. 3, the shaft inclining device 70 includes a belt deviation detector 130, a shaft inclining member 131, a side plate 150 (i.e., a stationary frame part) of the secondary transfer device 50, and a rotation support 134. The rotation support 134 is a holder to hold the separation roller shaft 61*a* movably. These components are disposed on the separation roller shaft 61*a* and arranged in that order from a center side in the axial direction (belt width direction) of the separation roller 61. The separation roller shaft 61*a* penetrates these components.

As illustrated in FIG. 2A, the rotation support 134 supports the end of the separation roller shaft 61*a* so that the end of the separation roller shaft 61*a* is movable, thereby supporting the separation roller 61. The rotation support 134 is rotatably attached to an end of a rotation shaft 17*a* of the secondary transfer roller 17. The rotation support 134 is biased clockwise in FIGS. 2A and 2B by a support spring 140. One end of the support spring 140 is secured to the side plate 150 of the secondary transfer device 50.

The rotation support 134 includes a separation roller support 134*a* to support the separation roller shaft 61*a* via a bearing 134*b* (illustrated in FIG. 3). The bearing 134*b* is fitted around the separation roller shaft 61*a*. The separation roller support 134*a* is biased by a tension spring 132 in a direction drawing away from the secondary transfer roller 17. The separation roller support 134*a* is supported by a base plate of the rotation support 134 slidably from the center of rotation of the rotation support 134 in the radial direction. With this configuration, the separation roller 61 constantly receives a biasing force in the direction drawing away from the secondary transfer roller 17 and gives a certain tension to the secondary transfer belt 60.

Additionally, first and second projections A and B are disposed on a face of the separation roller support 134*a* facing the side plate 150. The first and second projections A and B contact the side plate 150. The first and second projections A and B are described in detail later.

On the side closer to the center side than the separation roller support 134*a* in the axial direction of the separation roller shaft 61*a*, as illustrated in FIG. 3, the belt deviation detector 130 and the shaft inclining member 131 are disposed movably on the separation roller shaft 61*a*. The belt deviation detector 130 serves as a contact part (or an abutment part) that contacts (or abuts against) an end of the secondary transfer belt 60. As the secondary transfer belt 60 moves in the axial direction of the separation roller shaft 61*a*, the belt deviation detector 130 moves together with the shaft inclining member 131 on the separation roller shaft 61*a*.

Next, a description is provided of deviation adjustment of the secondary transfer belt 60 by the shaft inclining device 70.

When the secondary transfer roller 17, which is a driving roller, starts rotating, the separation roller 61, which is a driven roller), starts rotating. Around the secondary transfer roller 17 and the separation roller 61, the secondary transfer belt 60 is looped. At that time, in a case where the end of the secondary transfer belt 60 is in contact with the belt deviation detector 130, the belt deviation detector 130 starts rotating as well.

In this state, if the secondary transfer belt 60 is drawn to the right in FIG. 3 in the belt width direction (the axial direction of the separation roller 61) due to effects of parallelism between the components, the right end (in FIG. 3) of the secondary transfer belt 60 in the belt width direction contacts the belt deviation detector 130. In this specification, the term "belt deviation" means that the belt is drawn to one side in the belt width direction. Receiving the force of contact, the belt deviation detector 130 moves along the separation roller shaft 61*a* to the end side (right side in FIG. 3) in the axial direction thereof. As the belt deviation detector 130 moves toward the end of the separation roller shaft 61*a*, the shaft inclining member 131 is pushed by the belt deviation detector 130 to the end side in the axial direction. The shaft inclining member 131 is closer to the end of the rotation shaft 61*a* than the belt deviation detector 130. Then, the shaft inclining member 131 also moves along the separation roller shaft 61*a* to the end side in the axial direction.

The upper side of the shaft inclining member 131 in FIG. 3 includes an inclined face (131*b* in FIG. 6) inclined relative to the separation roller shaft 61*a*. Against the inclined face, a guide 135 (i.e., a shaft guide), which is disposed on the side plate 150, abuts from the end side (right side in FIG. 3) in the axial direction. A lower end of the inclined face of the shaft inclining member 131 is continuous with a stopper 131*c* extending in the axial direction of the separation roller shaft 61*a*. The position of the inclined face is not limited to the upper side of the shaft inclining member 131. The inclined face is inclined such that the inclined face approaches the axis of the separation roller 61 as the position in the axial direction moves to the end side.

An end portion of the separation roller shaft 61*a* closer to the end (on right in FIG. 3) in the axial direction than the shaft inclining member 131 is supported by the separation roller support 134*a* via the bearing 134*b*, as described above. Since the support spring 140 biases the rotation support 134 to rotate clockwise in FIGS. 2A and 2B around the secondary transfer roller 17, the end of the separation roller shaft 61*a* is biased upward in FIG. 3.

In a state in which the end of the secondary transfer belt 60 in the belt width direction is contactless with the belt deviation detector 130, the stopper 131*c* of the shaft inclining member 131 is urged upward by the support spring 140 and contacts a lower face of the guide 135. Accordingly, at the position at which the stopper 131*c* of the shaft inclining member 131 contacts the guide 135, the contact position between the inclined face of the shaft inclining member 131 and the guide 135 is determined. Accordingly, in the state in which the guide 135 abuts against the lower end of the inclined face of the shaft inclining member 131, the relative positions thereof are maintained.

From this state, when the secondary transfer belt 60 receives force toward the right in FIG. 3 in the belt width direction, as described above, the end of the secondary transfer belt 60 in the belt width direction contacts the belt deviation detector 130. Then, the belt deviation detector 130 and the shaft inclining member 131 move along the separation roller shaft 61*a* to the end side (right side in FIG. 3) in the axial direction. At that time, the guide 135 relatively moves along the inclined face of the shaft inclining member 131. Accordingly, the position at which the inclined face of the shaft inclining member 131 contacts the guide 135 is about to move up on the inclined face.

As a result, the end portion of the separation roller shaft 61*a* on the side to which the secondary transfer belt 60 has been drawn (i.e., "belt drawing side") is pushed down against the upward biasing force exerted by the support spring 140.

At this time, on the side (left side in FIG. 3) opposite the belt drawing side, the end portion of the secondary transfer belt 60 is not in contact with the belt deviation detector 130. Therefore, similar to FIG. 3, in the end portion of the separation roller shaft 61*a* on the side opposite the belt drawing side, the guide 135 is kept in contact with the lower end of the inclined face of the shaft inclining member 131.

Accordingly, the end portion of the separation roller shaft 61*a* on the belt drawing side is pressed lower relative to the other end, thereby tilting the separation roller shaft 61*a* as illustrated in FIGS. 2B and 4.

As the separation roller shaft 61*a* thus tilts, the speed at which the secondary transfer belt 60 deviates in the belt width direction gradually slows down, and, eventually, the secondary transfer belt 60 moves in the direction opposite to the belt drawing direction. As a result, the deviated secondary transfer belt 60 gradually returns to the original position in the belt width direction. Thus, the secondary transfer belt 60 can reliably travel with the belt deviation in the belt width direction settled. The same is true for the case where the secondary transfer belt 60 is drawn to the opposite side to the case described above.

A description is provided of a principle of correction of deviation of the secondary transfer belt 60 by tilting the separation roller shaft 61*a*.

It is assumed that the secondary transfer belt 60 is a rigid body, and an arbitrary point on the secondary transfer belt 60 upstream in the belt travel direction from the region winding around the separation roller 61 is observed. In a case where the secondary transfer belt 60 looped around the separation roller 61 and the secondary transfer roller 17 is fully horizontal or parallel, as the separation roller 61 rotates, the arbitrary point on the secondary transfer belt 60 does not move in the axial direction of the separation roller 61 but rotates around the separation roller 61. Accordingly, belt deviation does not occur.

By contrast, in a case where the separation roller shaft 61*a* is inclined by an inclination angle $\alpha$ relative to the rotation shaft 17*a* of the secondary transfer roller 17, the arbitrary point on the secondary transfer belt 61 deviates by an amount approximately equivalent to tan α in the axial direction of the separation roller 61 while moving along the peripheral surface of the separation roller 61. Accordingly, the separation roller shaft 61*a* is inclined down by the inclination angle α relative to the secondary transfer roller 17 disposed upstream in the direction in which the secondary transfer belt 60 advances to the separation roller 61. With this operation, in accordance with rotation of the separation roller 61, the position of the secondary transfer belt 60 in the belt width direction can be moved approximately by the tan α. Since this is a physical interaction, in a case where the separation roller shaft 61*a* is inclined above the horizontal direction, the secondary transfer belt 60 can be drawn to the right in FIG. 3 in accordance with rotation of the separation roller 61.

The amount by which the secondary transfer belt 60 is drawn to one side (moving speed in the belt width direction) is proportional to the inclination angle α. That is, the amount of drawing to one side of the secondary transfer belt 60 increases as the inclination angle α increases, and the amount of drawing to one side decreases as the inclination angle α decreases. For example, in a case where the secondary transfer belt 60 has been drawn to the right in FIG. 3 (i.e., initial deviation), this belt deviation causes the shaft inclining member 131 to move in the axial direction of the separation roller shaft 61*a*, thereby lowering the separation roller shaft 61*a* in FIG. 3 and drawing back the secondary transfer belt 60 to the left in FIG. 3 (i.e., opposite deviation). Then, the belt deviation can be corrected and the secondary transfer belt 60 is adjusted at the position where the initial deviation (i.e., to the right in FIG. 3) is balanced with the opposite deviation caused by inclining the separation roller shaft 61*a* of the separation roller 61. Even when the secondary transfer belt 60 traveling at the balanced position starts to deviate to either side, the separation roller shaft 61*a* is then inclined in accordance with the deviation of the secondary transfer belt 60, thereby again bringing the secondary transfer belt 60 to another balanced position.

As described above, according to the present embodiment, the shaft inclining device 70 of the secondary transfer device 50 tilts the separation roller shaft 61*a* by an inclination angle corresponding to the amount of deviation of the secondary transfer belt 60 in the belt width direction, thereby promptly correcting the deviation of the secondary transfer belt 60. Further, the force of the secondary transfer belt 60 moving in the belt width direction is used to tilt the separation roller shaft 61*a*. Accordingly, belt deviation can be corrected with a simple structure, and use of an additional drive source such as a motor is obviated.

If the separation roller shaft 61*a* of the separation roller 61 is not tilted and the range of belt deviation is not restricted, the end face of the secondary transfer belt 60 is directly pressed by the belt deviation detector 130 disposed at the end of the separation roller 61. Thus, stress is constantly given to the end face of the secondary transfer belt 60. End faces are weakest portions of the belt. When the secondary transfer belt 60 ran in a state in which stress was constantly given to the secondary transfer belt 60, folding of an end portion of the secondary transfer belt 60 was observed now and then.

According to the shaft inclining device 70 of the present embodiment, the separation roller 61 is tilted to reduce the load on the end faces of the secondary transfer belt 60 and control the belt deviation.

Next, a description is provided of an example of the separation roller 61 and the secondary transfer belt 60.

Outer diameter of separation roller: 14 mm
Material of separation roller: Aluminum
Material of secondary transfer belt: Polyimide
Young's modulus of secondary transfer belt: 3000 MPa
Folding endurance (number of times) of secondary transfer belt measured in Massachusetts Institute of Technology (MIT) folding endurance test: 6000 times
Thickness of secondary transfer belt: 80 μm
Linear speed of secondary transfer belt: 352 mm/s
Length of secondary transfer belt in main scanning direction: 350 mm
Belt tension: 1.15 N/cm The measuring method of the MIT folding endurance test conforms to Japanese Industrial Standard (JIS)-P8115. More specifically, the values mentioned above are obtained when a sample belt having a width of 15 mm is measured under conditions of a testing load of 1 kgf, a flexion angle of 135 degrees, and a flexion speed of 175 times per minute.

Additionally, in the structure that inclines the roller for belt deviation adjustment, as the roller is inclined, the force of pressing contact arises in an attachment portion of the shaft of the roller or a support member to support the shaft. Due to friction caused by rotation of the roller or the pressing force arising from inclining of the roller, the contract portions may be abraded or deformed. To inhibit such inconveniences, in the shaft inclining device 70 according to the present embodiment, gaps are secured between the bearing 134*b* and the separation roller support 134*a*, between the separation roller support 134*a* and the rotation support 134, and the rotation support 134 and the bearing of the secondary transfer roller 17. The gaps are to allow the separation roller support 134*a* and the rotation support 134 to incline as the separation roller 61 inclines. This structure can inhibit the force of pressing contact from arising at the bearing 134*b*, the separation roller support 134*a*, and the rotation support 134, as the separation roller 61 inclines.

Next, the first and second projections A and B, which are distinctive features of the present embodiment, are described.

In a structure in which the holder to hold the rotation shaft of the roller (hereinafter "inclining roller") movably or to be inclined is disposed facing a stationary part, such as a side plate secured to the belt unit or a frame part of the belt unit, there is a risk that the load applied to a belt end (i.e., the end of the secondary transfer belt 60 in the present embodiment) increases when the inclining roller is inclined. Specifically, for example, in a case where the stationary part and the holder are attached to the device body in a state in which the stationary part contacts the holder, while the inclining roller is inclined, due to the pressing force caused by the movement of the belt end, the force in the direction in which the rotation shaft of the inclining roller moves (hereinafter "force in the shaft moving direction") is given to the holder via the bearing and the like. The force in the shaft moving direction causes the holder to press against the stationary part, and the resistance due to friction between the stationary part and the holder increases, thereby inhibiting the holder from moving. Then, when the belt end contacts a belt contact part (the belt deviation detector 130 in one embodiment), the load applied on the belt end to move the holder increases.

In a case where gaps are provided to allow the rotation support 134 to incline, as in the shaft inclining device 70 of the present embodiment, the holder can be inclined relative to the stationary part as the inclining roller is inclined. In such a case, there is a risk of increases in the load on the belt end as follows. Depending on the maximum inclination amount of the inclining roller, it is possible that a portion of the inclined holder contacts the stationary part, and the area of contact between the stationary part and the holder increases as the inclining roller is inclined. Accordingly, the resistance due to the friction between the stationary part and the holder increases, which inhibits the holder from moving, and the load applied to the belt end increases as described above.

As the load on the belt end increases, the belt end tends to crack with elapse of time. Accordingly, the resistance due to the friction between the holder and the side plate is preferably suppressed.

In the shaft inclining device 70 according to the present embodiment, to suppress the load on the belt end, the rotation support 134 includes the first projection A and the second projection B, both of which contact the side plate 150. This structure enables the rotation support 134 to contact the side plate 150 via the two projections, namely, the first and second projections A and B. Then, compared with a structure in which such projections are not provided, advantageously, the area of contact between the rotation support 134 and the side plate 150 during inclining of the separation roller shaft 61*a* can be reduced. Since the resistance between the side plate 150 and the rotation support 134 is reduced, on the occurrence of belt deviation, the force required to move the rotation support 134 can be smaller. The force is applied by the end of the secondary transfer belt 60 to the belt deviation detector 130. Accordingly, the load on the belt end is reduced, thereby inhibiting the crack of the belt end.

Although the description above concerns the structure in which two projections are provided, the number of projections is not limited thereto but can be one or greater than two.

Figure 8:
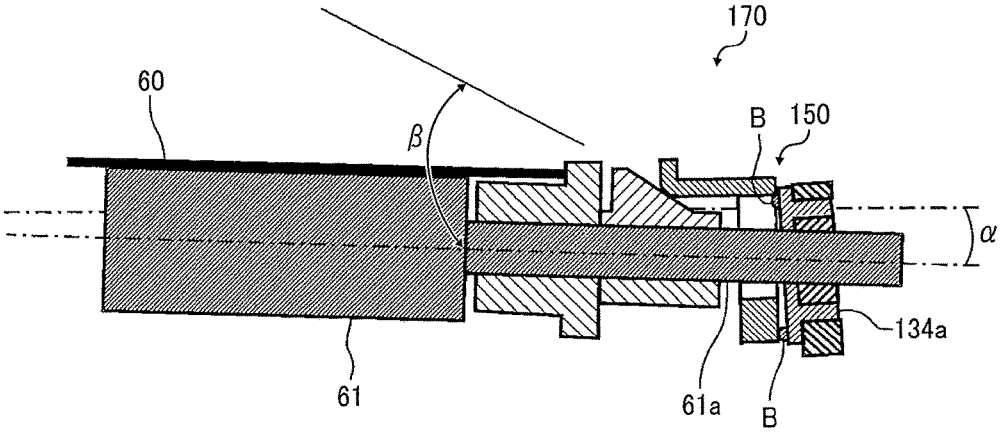
FIG. 8 is a schematic cross-sectional view of a shaft inclining device according to a comparative example, after adjustment of belt deviation, cut along a rotation shaft.

FIG. 8 is a schematic cross-sectional view of a shaft inclining device 170 according to a comparative example, after adjustment of belt deviation.

The cross section is cut along the separation roller shaft 61*a* of the separation roller 61. Components of the shaft inclining device 170 according to the comparative example similar to those of the shaft inclining device 70 illustrated in FIGS. 3 and 4 are given identical reference numerals, and redundant descriptions are omitted.

In a case illustrated in FIG. 8, in which the separation roller support 134*a* includes two projections B that are hemispherical and disposed at positions to contact the side plate 150, although the area (or range) of contact between the side plate 150 and the rotation support 134 is reduced, the following inconvenience may arise depending on the shape of the side plate 150. If the size of the side plate 150 is limited because of the space for component layout, the range on the side plate 150 contactable with the projections may be small.

In the shaft inclining device 170 according to the comparative example illustrated in FIG. 8, the range on the side plate 150 contactable with the upper one of the two projections B is smaller than the amount by which the upper one moves while the separation roller 61 is inclined. Accordingly, as illustrated in FIG. 8, the projection B may be disengaged from the side plate 150 while the separation roller 61 is inclined. When the projection B is disengaged from the side plate 150, the area of contact between the side plate 150 and the rotation support 134 may increase, or the projection is caught on the side plate 150 when the inclined separation roller 61 is returned to an initial position. Therefore, the contact between the projection and the side plate 150 should be maintained even if the range on the side plate 150 contactable with the projection is small.

Figure 5:
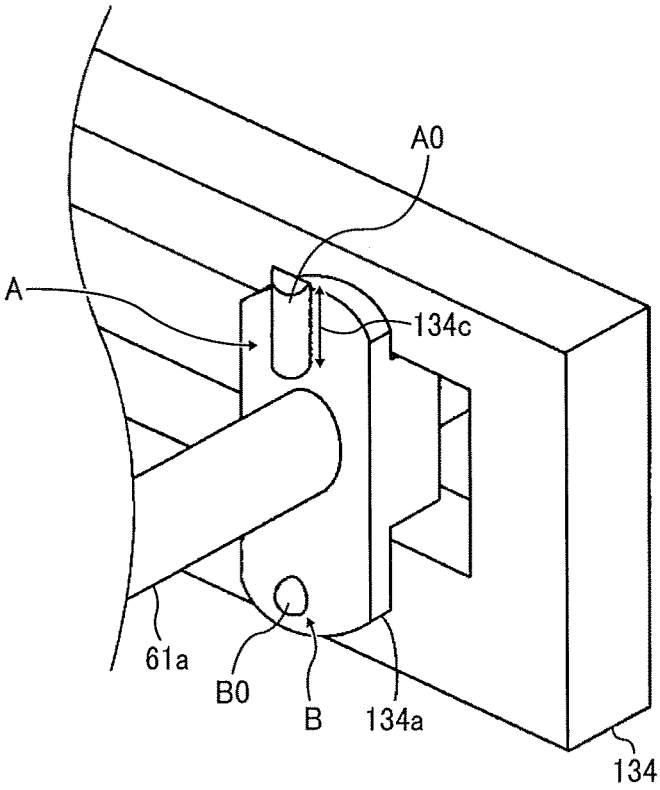
FIG. 5 is a schematic perspective view of an example shape of projections of the shaft inclining device according to an embodiment.

FIG. 5 is a schematic perspective view of an example shape of the first and second projections A and B of the shaft inclining device 70 illustrated in FIGS. 2A through 4.

In the shaft inclining device 70 according to the present embodiment, the first projection A, which is the upper one of the two projections, is long in the direction in which the separation roller shaft 61*a* moves. A contact portion A0 of the first projection A to contact the side plate 150 is long in the direction in which the separation roller shaft 61*a* moves (hereinafter also "moving direction of the separation roller shaft 61*a*"). Specifically, as illustrated in FIGS. 3 and 5, the first projection A is semi-cylindrical and has a curved face as the contact portion A0 contactable with the side plate 150. Such a shape is advantageous even in the case where the range on the side plate 150 contactable with the first projection A is small (in other words, the length of the side plate 150 in the shaft moving direction is short), relative to the amount of displacement of the first projection A. That is, even when the separation roller shaft 61*a* is inclined significantly, the first projection A is kept in contact with the side plate 150 as illustrated in FIG. 4. This structure can inhibit disengagement of the projection from a contacted member (i.e., the side plate 150) and inhibit increases in the area of contact between the rotation support 134 and the side plate 150 caused thereby.

A maximum displacement of the first projection A and the second projection B is defined by an inclination angle β of the inclined face 131*b* (in FIG. 6) of the shaft inclining member 131 and a distance Za (illustrated in FIG. 7) between the shaft inclining member 131 and a stopper 137*a*. On the left side in FIG. 7, the distance Za is replaced with a distance Zb between the shaft inclining member 131 and a stopper 137*b*.

In the present embodiment, the contact of the first projection A with the side plate 150 is line contact since the curved face of the semi-cylindrical first projection A contacts the side plate 150. This structure can further reduce the area of contact between the side plate 150 and the rotation support 134, thereby reducing the resistance between the side plate 150 and the rotation support 134.

In the direction in which the separation roller shaft 61*a* moves, the portion of the first projection A contactable with the side plate 150 is longer than the maximum displacement of a projection mount 134*c* of the rotation support 134 in which the first projection A is mounted. With this structure, even when the separation roller shaft 61*a* is inclined to maximum, the first projection A is constantly in contact with the side plate 150. Accordingly, the load on the belt end is reduced as described above, thereby inhibiting the crack of the belt end for a long time.

Additionally, in the shaft inclining device 70 of the present embodiment, the rotation support 134 and the side plate 150 can contact with each other via the two projections, that is, the first and second projections A and B. Compared with a case where one projection is provided, the contact between the rotation support 134 and the side plate 150 is more stable.

In the present embodiment, the second projection B is hemispherical and has a curved face to contact the side plate 150. With this structure, since the second projection B of the rotation support 134 makes a point contact with the side plate 150, the second projection B can constantly contact the side plate 150 even when the rotation support 134 is inclined relative to the side plate 150. This structure can further reduce the area of contact between the side plate 150 and the rotation support 134, thereby reducing the resistance between the side plate 150 and the rotation support 134.

Additionally, in the direction in which the separation roller shaft 61*a* moves, the portion of the second projection B contactable with the side plate 150 is shorter than that of the first projection A. Compared with a case where two first projections A are provided, this structure can reduce the area of contact with the side plate 150 and reduce the resistance between the side plate 150 and the rotation support 134.

If the maximum displacement of each projection during inclining of the separation roller shaft 61*a* is greater than the length of the contacted portion on the side plate 150 contacted by each projection, as described above, the projection may be disengaged from the side plate 150 depending on the shape of the projection.

Therefore, in the present embodiment, as illustrated in FIG. 3, the first and second projections A and B are disposed as follows.

Assuming that X represents the maximum displacement (in the moving direction of the separation roller shaft 61) of the contacted portion on the side plate 150 (contacted by one of the first and second projections A and B) during inclining of the separation roller shaft 61*a*, and Y represents the length (150A or 150B in FIG. 3), in direction in which the separation roller shaft 61*a* moves, of the contacted range on the side plate 150 contacted by the first projection A or the second projection B. The first projection A is disposed at a position where X>Y is satisfied, and the second projection B is disposed at a position where X<Y is satisfied.

When the semi-cylindrical first projection A is disposed at the position where the maximum displacement X is greater than the length 150A, the contact between the side plate 150 and the projection is maintained even if the separation roller 61 is significantly inclined. By contrast, the hemispherical second projection B is disposed at the position where the maximum displacement X is smaller than the length 150B so as to reduce the area of contact between the side plate 150 and the rotation support 134. Accordingly, as described above, the load on the belt end is reduced as described above, thereby inhibiting the crack of the belt end for a long time.

Further, on the cross section illustrated in FIGS. 2A and 2B, the first and second projections A and B are disposed at positions symmetrical with respect to a line connecting the separation roller shaft 61*a* and the rotation shaft 17*a* of the secondary transfer roller 17. With the symmetrical placement, the posture of the rotation support 134 can be stable relative to the side plate 150. Then, the resistance arising between the rotation support 134 and the side plate 150 can be reduced, and the crack of the belt end can be inhibited for a long time.

In the shaft inclining device 70 according to the present embodiment, the first and second projections A and B are in contact with the side plate 150 while the separation roller shaft 61*a* is moved (or inclined). Since the separation roller 61 is inclined in this state, the rotation support 134 can be kept substantially parallel to the side plate 150. Then, the resistance between the rotation support 134 and the side plate 150, arising during inclining of the separation roller 61, can be reduced, and the crack of the belt end can be inhibited for a long time.

In the shaft inclining device 70 according to the present embodiment, for example, the contacted portion on the side plate 150, contacted by the first projection A, is 3 mm in the moving direction of the separation roller shaft 61. The semi-cylindrical portion of the first projection A (i.e., the contact portion A0 with the side plate 150) is 1 mm in radius and 4 mm in the moving direction of the separation roller shaft 61. The hemispherical portion (curved face) of the second projection B (i.e., a contact portion B0 with the side plate 150) is 1 mm in radius.

Preferably, the total area of contact of the first and second projections A and B with the contacted portion (the side plate 150) is equal to or greater than 0.5 mm and equal to or smaller than 2 mm. If the total area of contact is not smaller than 2 mm, a large load may the given to the belt end.

It is to be noted that, although the description above concerns the structure in which the separation roller support 134*a* of the rotation support 134 includes the first and second projections A and B, the location of the first and second projections A and B are not limited thereto. The location of the first and second projections A and B can be between the side plate 150 (i.e., the stationary frame part) and the rotation support 134 (i.e., the holder) and at a position to contact the side plate 150 or the rotation support 134. For example, in another embodiment, the side plate 150 includes the projection, and the rotation support 134 has a flat face to be contacted by the projection.

Next, a description is provided of the shaft inclining member 131.

Figure 6:
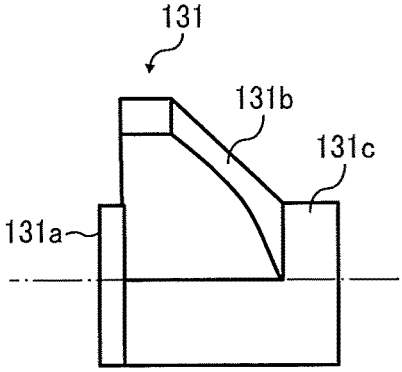
FIG. 6 is a schematic side view of an example of a shaft inclining member of the shaft inclining device according to an embodiment.

FIG. 6 is a schematic view of the shaft inclining member 131 of the shaft inclining device 70.

As illustrated in FIG. 6, the shaft inclining member 131 of the present embodiment has a cylindrical body, and a projection having the inclined face 131*b* (illustrated in FIG. 6) projects from the outer face of the cylindrical body. The inclined face 131*b* is curved to confirm to the surface of a conical shape coaxial with the axis of the cylindrical body. The inclined face 131*b* being a curved face is advantageous in inhibiting the separation roller 61 from changing the inclination angle thereof even when the shaft inclining member 131 rotates slightly around the separation roller shaft 61*a*. Additionally, since the curved face can reduce the area of contact with the guide 135 close to a point contact, the friction at the point of contact is alleviated. Accordingly, the curved face can reduce the pressure of contact between the end of the secondary transfer belt 60 and the belt deviation detector 130. Accordingly, wear or degradation of the end of the secondary transfer belt 60 is restricted to expand the life of the secondary transfer belt 60.

Additionally, as described above, the shaft inclining member 131 of the present embodiment includes the stopper 131*c* at the lower end of the inclined face 131*b*. The stopper 131*c* can be also used for positioning. As illustrated in FIG. 3, the stopper 131*c* being positioned at an initial position is in contact with the guide 135 projecting from the side plate 150. The guide 135 projects inward (to the center side) in the axial direction of the separation roller 61. With the contact between the lower face of the guide 135 and the stopper 131*c*, the inclination of the separation roller 61 in an initial stage after assembling can be constant.

In the present embodiment, the inclination angle β of the inclined face 131*b* of the shaft inclining member 131, relative to the rotation shaft 61*a*, is approximately 30 degrees, and the shaft inclining member 131 is made of, but is not limited to, polyacetal (POM).

The guide 135 has a linear corner portion that contacts the inclined face 131*b* of the shaft inclining member 131, and the corner portion is rounded (curved), in particular, into R-shape.

Next, descriptions are given of the stoppers 137*a* and 137*b* of the side plate 150.

Figure 7:
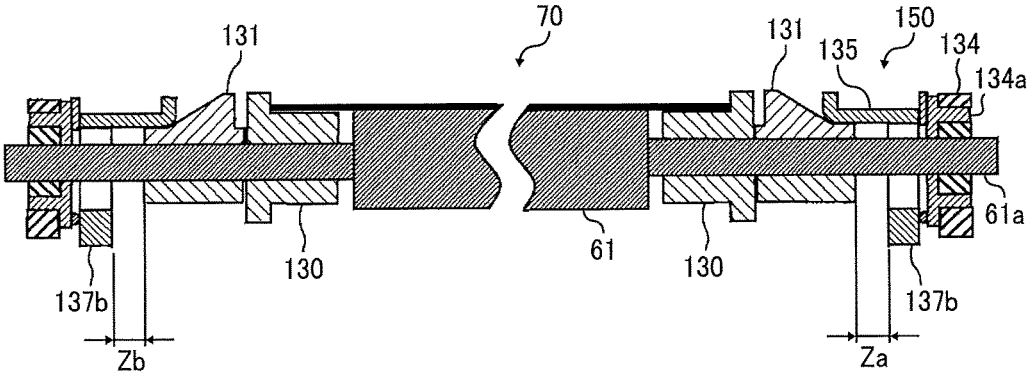
FIG. 7 is a schematic side view of the shaft inclining device.

FIG. 7 is a schematic cross-sectional view of the shaft inclining device 70 immediately after assembling.

As described above, the shaft inclining member 131 is movable in the axial direction of the separation roller 61. In the shaft inclining device 70 of the present embodiment, the side plates 150 include the stoppers 137*a* and 137*b* to restrict the amount of movement of the shaft inclining member 131 in the axial direction to a predetermined amount. As the shaft inclining member 131 moves to the right in FIG. 7, an end of the stopper 131*c* of the shaft inclining member 131 contacts the stopper 137*a* of the side plate 150. Then, the shaft inclining member 131 is inhibited from moving in the axial direction.

In the present embodiment, the stopper 137*a* is disposed so that the shaft inclining member 131 moves in the axial direction by the distance Za to the right and by a distance Zb to the left in FIG. 7. As described above, since the separation roller 61 can be inclined by the amount by which the shaft inclining member 131 has moved in the axial direction, the maximum inclination amount of the separation roller 61 can be restricted by restricting the amount of movement of the shaft inclining member 131.

Although, in the description above, the stopper 137*a* disposed on the side plate 150 serves as a restricting member to restrict the movement of the shaft inclining member 131, the restricting member is not limited thereto. In another embodiment, the shaft inclining member 131 is prevented from moving in the axial direction when the haft inclining member 131 contacts a component different from the side plate 150. For example, the shaft inclining member 131 is stopped upon contact with the separation roller support 134*a* or the rotation support 134.

The structures described above are just examples, and the various aspects of the present specification attain respective effects as follows.

Aspect A

Aspect A concerns a belt control device, such as the shaft inclining device 70*a*, that controls (in particular, adjusts the deviation of the belt) an endless belt, such as the secondary transfer belt 60 looped around a plurality of rotators, such as the separation roller 61 and he secondary transfer roller 17. The belt control device includes a holder, such as the rotation support 134, to movably support the rotation shaft (e.g., the separation roller shaft 61*a*) of at least one of the plurality of rotators; a contact part (e.g., the belt deviation detector 130) to contact an end of the belt as the belt moves in the belt width direction; a stationary frame part, such as the side plate 150, which is a part of a device frame; and a belt moving member (e.g., the belt inclining member 131) to move the rotation shaft as the belt moves.

The belt control device further includes at least one projection disposed on at least one of the stationary frame part and the holder such that the projection contacts the other of the stationary frame part and the holder. The projection includes a long projection (e.g., the first projection A) having a contact portion (A0) contactable with the other of the stationary frame part and the holder, and the contact portion (A0) is long in the direction in which the rotation shaft moves (i.e., the shaft moving direction).

In a structure in which the holder to movably hold the rotation shaft is disposed facing the stationary frame part or a component secured to the devices body, there is a risk that the load applied to the end of the belt increases when the inclining roller is inclined. Specifically, for example, in a case where the stationary frame part and the holder are attached to the device body in a state in which the stationary frame part contacts the holder, while the inclining roller is inclined, due to the pressing force caused by the movement of the belt end, the force in the direction in which the rotation shaft of the inclining roller moves (hereinafter "force in the shaft moving direction") is given to the holder via the bearing and the like. The force in the shaft moving direction causes the holder to press against the stationary frame part, and the resistance due to friction between the stationary frame part and the holder increases, thereby inhibiting the holder from moving. Then, when the belt end contacts the belt contact part, the load on the belt end generated to move the holder increases.

Additionally, in a case where the holder can be inclined relative to the stationary frame part as the inclining roller is inclined (e.g., the belt control device includes gaps to allow the holder to incline), there is a risk that the load on the belt end increases as follows. Depending on the maximum inclination amount of the inclining roller, it is possible that a portion of the inclined holder contacts the stationary frame part, and the area of contact between the stationary frame part and the holder increases as the inclining roller is inclined. Accordingly, the resistance due to the friction between the stationary frame part and the holder increases, which inhibits the holder from moving, and the load applied to the belt end increases as described above.

As the load on the belt end increases, the belt end tends to crack with elapse of time. Accordingly, the resistance due to the friction between the holder and the side plate is preferably suppressed.

According to this aspect, as described above, with the first projection A and the second projection B disposed on the rotation support 134 and designed to contact the side plate 150, the side plate 150 and the rotation support 134 can contact with each other via the projections. Compared with a configuration in which the projection (or protections) is not disposed on either the side plate 150 or the rotation support 134, this aspect can reduce the area of contact between the side plate 150 and the rotation support 134 during movement of the separation roller shaft 61*a*. Since the resistance between the side plate 150 and the rotation support 134 is reduced, on the occurrence of belt deviation, the force required to move the rotation support 134 can be smaller. The force is applied by the belt end to the belt deviation detector 130. Accordingly, the load on the belt end is reduced, thereby inhibiting the crack of the belt end.

If the size of the stationary frame part (e.g., the side plate 150) or the holder (e.g., the rotation support 134), which contacts the projection (or projections), is limited because of the space for component layout, the range on the stationary frame part or the holder contactable with the projections may be small. In the case where the contactable area on the stationary frame part or the holder contactable with the projection is smaller than the displacement of the projection during inclining of the rotation shaft, the contact of the projection with the stationary frame part or the holder may be canceled while the rotation shaft is inclined. If the contact is canceled, the area of contact between the stationary frame part and the holder may increase, or the projection is caught on the stationary frame part or the holder when the inclined roller is returned to an initial position. Therefore, the contact between the projection and the stationary frame part or the holder should be maintained even if the contactable range on the stationary frame part or the holder contactable with the projection is small.

According to this aspect, the belt control device includes the long projection (e.g., the first projection A) having the contact portion (A0) contactable with the side plate 150 and extending in the in the shaft moving direction in which the separation roller 61 moves or inclines. Accordingly, even in the case where, relative to the displacement of the first projection A, the contactable range on the side plate 150 contactable with the first projection A is small, the first projection A is kept in contact with the side plate 150 for a longer time even if the separation roller shaft 61*a* is inclined significantly. This structure can suppress increases in the area of contact between the rotation support 134 and the side plate 150 caused by disengagement of the projection from the side plate 150.

Aspect B

In the belt control device according to Aspect A, the projection (e.g., the first projection A) has a semi-cylindrical shape, and the contact portion (A0) to contact either the stationary frame part (e.g., the side plate 150) or the holder (e.g., the rotation support 134) is a curved face.

According to this aspect, as described above, the first projection A disposed on the rotation support 134 makes line contact with the side plate 150 since the contact portion of the first projection A with the side plate 150 is the curved face. This structure can further reduce the area of contact between the side plate 150 and the rotation support 134, thereby reducing the resistance between the side plate 150 and the rotation support 134.

Aspect C

The belt control device according to Aspect A or B includes a long projection (e.g., the first projection A) having the contact portion (A0) contactable with one of the stationary frame part (e.g., the side plate 150) and the holder (e.g., the rotation support 134) and extending long in the direction in which the rotation shaft (e.g., the separation roller shaft 61*a*) moves. The belt control device further includes a short projection (e.g., the second projection B) having a contact portion (B0) contactable with one of the stationary frame part and the holder and shorter than the contact portion of the long projection in the shaft moving direction.

According to this aspect, as described above, the rotation support 134 and the side plate 150 can contact with each other via the two projections (the first and second projections A and B). Compared with a case where one projection is provided, the contact between the rotation support 134 and the side plate 150 is more stable. Additionally, in the direction in which the separation roller shaft 61*a* moves, the portion of the second projection B contactable with the side plate 150 is shorter than that of the first projection A. Compared with a case where two first projections A are provided, this structure can reduce the area of contact with the side plate 150.

Aspect D

In the belt control device according to Aspect C, the short projection (e.g., the second projection B) has a hemispherical shape, and the contact portion (B0) to contact either the stationary frame part (e.g., the side plate 150) or the holder (e.g., the rotation support 134) is a curved face.

According to this aspect, as described above, the second projection B disposed on the rotation support 134 makes point contact with the side plate 150 since the contact portion B0 of the second projection B with the side plate 150 is the curved face. With this aspect, the second projection B can be constantly kept in contact the side plate 150 even when the rotation support 134 is inclined relative to the side plate 150. This structure can further reduce the area of contact between the side plate 150 and the rotation support 134, thereby reducing the resistance between the side plate 150 and the rotation support 134.

Aspect E

In the belt control device according to Aspect C or D, the long projection (e.g., the first projection A) is disposed at a position where X>Y is satisfied, and the short projection (e.g., the second projection B) is disposed at a position where X<Y is satisfied when X and Y are defined as follows. X represents the maximum displacement in the shaft moving direction during inclining of the rotation shaft (e.g., the separation roller shaft 61*a* of:

a) the projection mount (e.g., 134*c* in FIG. 5), in which at least one projection is mounted, or b) the contacted portion contacted by the projection.

Further, Y represents the length (in the shaft moving direction) of the contacted range within which the projection can contact either the stationary frame part (e.g., the side plate 150) or the holder (e.g., the rotation support 134).

In this aspect, as described above, when the long projection, such as the semi-cylindrical first projection A, extending in the direction in which the separation roller shaft 61*a* moves, is disposed at the position where X>Y is satisfied, the contact between the side plate 150 and the projection is maintained even if the separation roller 61 is significantly inclined. By contrast, another projection (e.g., the hemispherical second projection B) having a smaller contactable range with the side plate 150 is disposed at the position where X<Y is satisfied so as to reduce the area of contact between the side plate 150 and the rotation support 134. Accordingly, as described above, the load on the belt end is reduced, thereby inhibiting the crack of the belt end for a long time.

Aspect F

In the belt control device according to any one of Aspects A through E, the length in the shaft moving direction of the contact portion (A0) of the long projection (e.g., the first projection A), which extends in the shaft moving direction, is longer than one of a) a projection mount (e.g., the projection mount 134*c*) in which the long projection is mounted; and b) a maximum displacement of the contacted portion contacted by the long projection in the shaft moving direction while the rotation shaft (e.g., the separation roller shaft 61*a*) moves.

In this aspect, as described above, the longitudinal length of the first projection A disposed on the rotation support 134 is made longer than the maximum displacement X of the first projection A to attain the following. Even when the separation roller shaft 61*a* is inclined to maximum, the first projection A can be constantly kept in contact with the side plate 150. Accordingly, as described above, the load on the belt end is reduced as described above, thereby inhibiting the crack of the belt end for a long time.

Aspect G

In the belt control device according to any one of Aspects C through F, the long projection (e.g., the first projection A) and the short projection (e.g., the second projection B) are kept in contact with either the stationary frame part (e.g., the side plate 150) or the holder (e.g., the rotation support 134) while the rotation shaft (e.g., the separation roller shaft 61*a*) moves.

According to this aspect, as described above, the first projection A and the second projection B disposed on the rotation support 134 are kept in contact with +the side plate 150 during inclining of the separation roller 61. Accordingly, the rotation support 134 and the side plate 150 can be kept parallel to each other. Then, the resistance between the rotation support 134 and the side plate 150, arising during inclining of the separation roller 61, can be reduced, and the crack of the belt end can be inhibited for a long time.

Aspect H

The belt control device according to any one of Aspects A through G includes a plurality of projections (e.g., the first projection A and the second projection B), and the plurality of projections are disposed symmetrically with each other with respect to a line connecting a) the rotation axis (e.g., the separation roller shaft 61*a*) of the rotator (e.g., the separation roller 61) supported by the holder (e.g., the rotation support 134) and the rotation axis (e.g., the rotation shaft 17*a*) of another one (e.g., the secondary transfer roller 17) of the plurality of rotators.

According to this aspect, as described above, in the arrangement in which the two projections (the first and second projections A and B) are symmetrical with each other with respect to the line connecting the separation roller shaft 61*a* (the axis thereof in particular) and the secondary transfer roller 17 (the axis thereof in particular), the distance between the side plate 150 and the rotation support 134 can be kept constant. Then, since the posture of the rotation support 134 relative to the side plate 150 is stable, the resistance arising between the rotation support 134 and the side plate 150 can be reduced, and the crack of the belt end can be inhibited for a long time.

Aspect I

A belt device (e.g., the secondary transfer device 50) includes a belt (e.g., the secondary transfer belt 60) looped into an endless shape; a plurality of rotators (e.g., the separation roller 61 and the secondary transfer roller 17) around which the belt is looped; a holder (e.g., the rotation support 134) to support a rotation shaft (e.g., the separation roller shaft 61*a*) of at least one (e.g., the separation roller 61) of the plurality of rotators movably; a contact part (e.g., the belt deviation detector 130) to contact an end of the belt as the belt moves in a belt width direction; a stationary frame part (e.g., the side plate 150) secured to an device body; and a shaft moving device (e.g., the shaft inclining device 70) according to any one of Aspects A through H, to move the shaft as the belt moves.

Aspect J

An image forming apparatus includes an image forming unit, such as the image forming unit 6, to form an image and the belt device, such as the secondary transfer device 50, according to Aspect I.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A belt control device, comprising:

a holder to movably support a rotation shaft of at least one of a plurality of rotators, around which a belt is looped;

a contact part to contact an end of the belt as the belt moves in a belt width direction;

a stationary frame part disposed facing the holder;

a shaft moving device to move the rotation shaft as the belt moves; and at least one projection disposed on one of the stationary frame part and the holder, the at least one projection to contact the other of the stationary frame part and the holder, the at least one projection including a long projection having a contact portion extending in a shaft moving direction in which the rotation shaft moves, the contact portion contactable with the other of the stationary frame part and the holder, wherein the at least one projection further includes a short projection having a short contact portion shorter than the contact portion of the long projection in the shaft moving direction, the short contact portion contactable with the other of the stationary frame part and the holder.

2. The belt control device according to claim 1, wherein the long projection has a semi-cylindrical shape, and wherein the contact portion is a curved face.

3. The belt control device according to claim 1, wherein the short projection has a hemispherical shape, and wherein the short contact portion is a curved face.

4. The belt control device according to claim 1, wherein the long projection is disposed at a position where is satisfied, and the short projection is disposed at a position where $X<Y$ is satisfied, wherein X represents a maximum displacement of the holder in the shaft moving direction while the rotation shaft moves, and Y represents a length of a contact range on one of the stationary frame part and the holder with which a corresponding one of the long projection and the short projection contacts.

5. The belt control device according to claim 1, wherein a length of the contact portion of the long projection in the shaft moving direction is longer than a maximum displacement of the holder in the shaft moving direction while the rotation shaft moves.

6. The belt control device according to claim 1, wherein the long projection and the short projection are kept in contact with one of the stationary frame part and the holder while the rotation shaft moves.

7. The belt control device according to claim 1, wherein the at least one projection includes a plurality of projections disposed at positions symmetrical with respect to a line connecting an axis of the rotation shaft supported by the holder and an axis of another one of the plurality of rotators.

8. A belt device comprising:

the belt looped into an endless shape;

the plurality of rotators around which the belt is looped; and the belt control device according to claim 1, to move the rotation shaft as the belt moves.

9. An image forming apparatus comprising:

an image forming unit to form an image; and the belt device according to claim 8, to transport one of the image and a recording medium bearing the image.

* * * * *